US008842500B2

(12) United States Patent
Schmidt

(10) Patent No.: US 8,842,500 B2
(45) Date of Patent: Sep. 23, 2014

(54) CALENDAR MECHANISM

(75) Inventor: Peter Schmidt, Glashuette-Schlottwitz (DE)

(73) Assignee: Glashütter Uhrenbetrieb GmbH, Glashütte (DE)

( * ) Notice: Subject to any disclaimer, the term of this patent is extended or adjusted under 35 U.S.C. 154(b) by 382 days.

(21) Appl. No.: 13/396,994

(22) Filed: Feb. 15, 2012

(65) Prior Publication Data

US 2012/0213038 A1 Aug. 23, 2012

(30) Foreign Application Priority Data

Feb. 17, 2011 (EP) ..... 11154850

(51) Int. Cl.
*G04B 19/24* (2006.01)
*G04B 19/253* (2006.01)

(52) U.S. Cl.
CPC ..... *G04B 19/2536* (2013.01)
USPC ..... 368/37

(58) Field of Classification Search
CPC ..... G04B 19/253; G04B 19/25333; G04B 19/25353; G04B 19/2536
USPC ..... 368/28, 35, 37
See application file for complete search history.

(56) References Cited

U.S. PATENT DOCUMENTS

| | | | | |
|---|---|---|---|---|
| 143,618 | A | 10/1873 | Frankfeld | |
| 5,699,321 | A * | 12/1997 | Vaucher | 368/37 |
| 6,744,696 | B2 * | 6/2004 | Vernay et al. | 368/37 |
| 7,839,724 | B2 * | 11/2010 | Schmiedchen et al. | 368/37 |
| 8,284,632 | B2 * | 10/2012 | Watanabe | 368/37 |
| 2005/0254350 | A1 | 11/2005 | Fleury | |

FOREIGN PATENT DOCUMENTS

| | | | |
|---|---|---|---|
| CH | 680 630 G | A3 | 10/1992 |
| CH | 682 284 G | A3 | 8/1993 |
| CH | 693 691 | A5 | 12/2003 |
| EP | 1 351 104 | A1 | 10/2003 |
| EP | 1 596 261 | A1 | 11/2005 |
| FR | 536.251 | | 4/1922 |
| FR | 1.005.738 | | 4/1952 |

OTHER PUBLICATIONS

U.S. Appl. No. 13/396,897, filed Feb. 15, 2012, Schimidt.
U.S. Appl. No. 13/397,086, filed Feb. 15, 2012, Schimidt.
European Search Report issued on Aug. 19, 2011 in corresponding European Application No. 11 15 4850 filed on Feb. 17, 2011 (with an English Translation).

* cited by examiner

*Primary Examiner* — Vit W Miska
(74) *Attorney, Agent, or Firm* — Oblon, Spivak, McClelland, Maier & Neustadt, L.L.P.

(57) ABSTRACT

Calendar mechanism comprising a day program wheel 13 that is driven by a clock movement and actuates a wheel train for display of the days of the month (16-24). The day program wheel 13 comprises a day indexing gear 13' that is advanced by one step each day by said clock movement, and at least one retractable tooth (128, 129, 130) capable of being driven by the clock movement and mounted to pivot between an active position (128A, 129A, 130A), in which it is driven, and an inactive position (128I, 129I, 130I), in which it is not driven by the clock movement.

15 Claims, 7 Drawing Sheets

26
0

1
2
3
4
5
6
6'
6"
7
8
9
10
48

CALENDAR MECHANISM

This application claims priority from European Patent Application No. 11154850.9 filed Feb. 17, 2011, the entire disclosure of which is incorporated herein by reference.

TECHNICAL FIELD

The present invention relates to a calendar mechanism and more specifically to a perpetual calendar mechanism.

PRIOR ART

Annual mechanisms, i.e. those that enable the display of the day of the month to be automatically incremented taking into account months of less than 31 days without requiring any manual intervention to correct these, as well as perpetual mechanisms, i.e. those that additionally take leap years into account for incrementing the day on the last day of the month of February, have long been known.

Perpetual mechanisms use a 12 or a 48 cam, wherein the latter performs a rotation respectively every year or every 4 years, with notches of different depths for months of less than 31 days. In the case of a 12 cam the February notch additionally comprises a Maltese cross indexed every year that defines a lesser depth for leap years. The beak of a lever, which is restored by a spring, acts on the cams used in these day display mechanisms to determine the advance of the day indicator at the end of the month depending on the depth at which this is engaged. This results in a relatively complex construction with a number of important pieces, but is not very reliable in operation, e.g. in the case of shocks. Moreover, this cam system only allows a day wheel and the base movement to be synchronised in a given direction such that the day values can only be incremented and not decremented during an hour adjustment operation.

To overcome these disadvantages, the solution disclosed in patent document CH 680630 proposes, for example, a perpetual mechanism comprising a program wheel, which is driven by protruding teeth of a 24-hour wheel and on which a gear train is arranged so that it is always moved along the number of steps corresponding to the differential between the number of days of the month and 31. This mechanism has no lever, balance or spring at all except for a jumper to index the day wheel. However, the gearing system is very complex with numerous planet wheels fitted with long teeth for indexing readjustments arranged eccentrically on the program wheel and are each dedicated to a particular correction. Consequently, this results not only in a significant height requirement on the plate, but also results in very high production costs because of the highly precise positioning required for the axes in order to guarantee reliable meshing with the 24-hour wheel.

Document EP1351104 proposes an alternative to the previous solution with the aim of reducing the number of components on the program wheel. Thus, the disclosed calendar mechanism proposes a program wheel provided with moving elements with retractable teeth sliding between active and inactive positions. This device enables the overall thickness of the program wheel to be reduced effectively. However, the sliding movable elements have very specific shapes and must be positioned precisely between abutments and shoulders with complex geometric shapes. Moreover, the control device still comprises numerous planet wheels with teeth of unequal length acting as cam surfaces on the sliding elements. Thus, both the meshing reliability is challenged and the wear of the different pieces of the control device is accentuated because of the numerous guide surfaces for the sliding elements.

There is therefore a need for calendar mechanisms, and in particular perpetual calendars, that are free of these limitations of the prior art.

BRIEF SUMMARY OF THE INVENTION

It is an aim of the present invention to provide an alternative solution to the usual calendar mechanisms with a simplified construction, in which the adjustment of the hour and the day can be synchronised in both directions.

Another aim of the present invention is to provide a solution that minimises energy losses during the different indexing operations, and in particular indexing readjustments at the end of months of less than 31 days.

These aims are achieved in particular by means of a calendar mechanism that comprises a day program wheel 13 that is driven by a clock movement and actuates a wheel train for display of the days of the month (16-24), wherein the program wheel 13 comprises a day indexing gear 13' that is advanced by one step each day by said clock movement, and at least one retractable tooth (128, 129, 130) that is capable of being driven by the clock movement, characterised in that the retractable tooth (128, 129, 130) is mounted to pivot between an active position (128A, 129A, 130A), in which it is driven by said clock movement, and an inactive position (128I, 129I, 130I), in which it is not driven by said clock movement.

An advantage of the proposed solution is to only require a reduced number of elements for the program wheel and parts of simple geometric shape for the retractable teeth.

Another advantage of the proposed solution is to guarantee better meshing reliability as a result of a reliable positioning of the retractable teeth, each being deep and conditioned by a single degree of freedom in rotation.

An additional advantage of the proposed solution is a better durability as a result of the limited wear for each retractable tooth during respective indexing operations.

Another advantage of the proposed solution is to be able to easily change each readjustment wheel train for automatically indexing the day in months of less than 31 days in a modular fashion meshing level by meshing level.

BRIEF DESCRIPTION OF THE FIGURES

Exemplary embodiments of the invention are indicated in the description and illustrated by the attached figures, wherein.

EMBODIMENT(S) OF THE INVENTION

The calendar mechanism according to the invention is preferably a perpetual calendar mechanism with display of the days of the week, 24 hours, months and leap years. However, a person skilled in the art will understand that various modules forming this calendar mechanism could also be used independently of one another for other types of calendar mechanisms and that the program wheel could equally be adapted to simpler mechanisms such as annual or 30-day month calendar mechanisms, for example, by adjusting the number of pivoting teeth and the number of meshing levels.

Figures 1A, 1B:
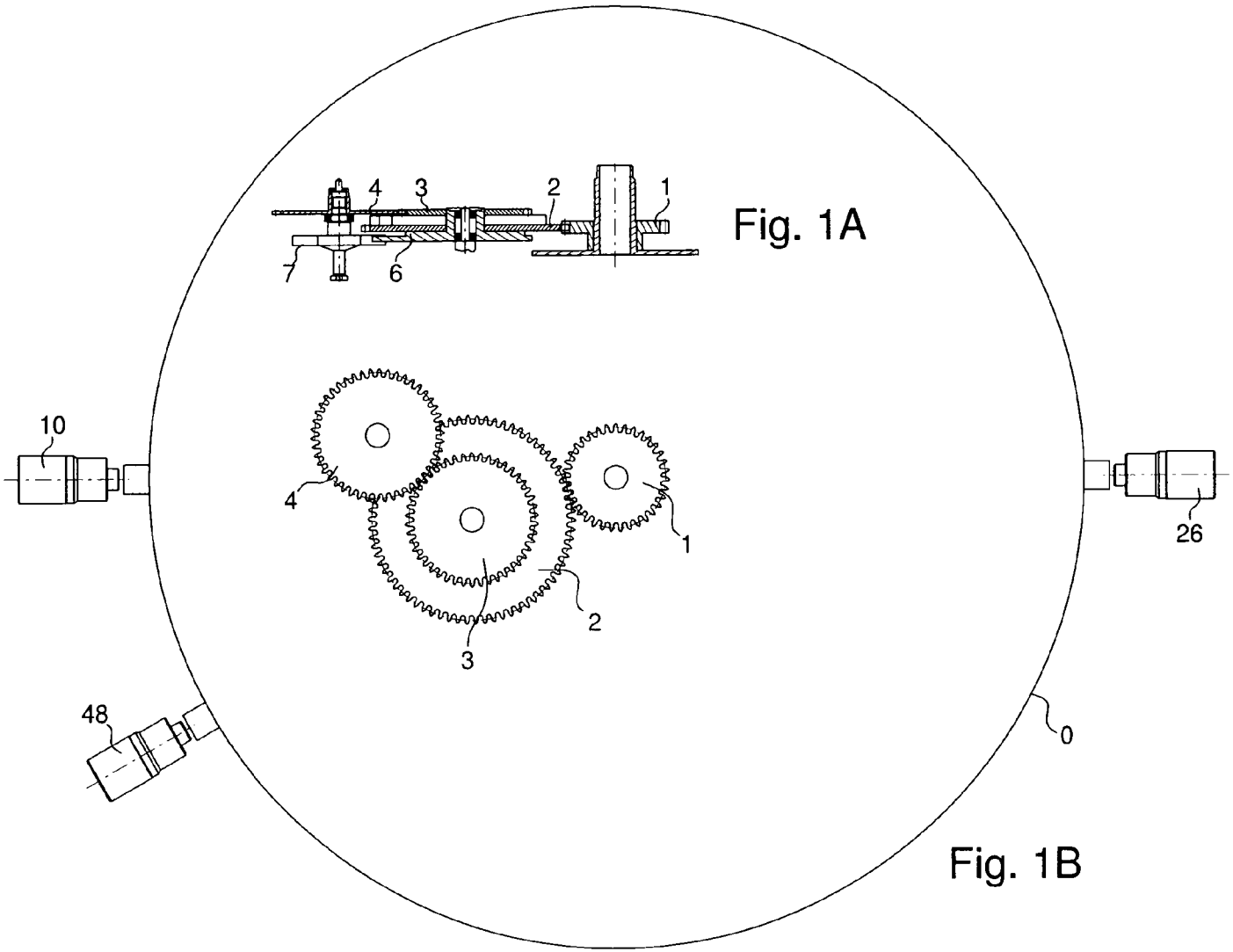
FIGS. 1A and 1B respectively show a sectional view and a plan view of a control mechanism for the display of 24 hours and the day of the week associated with the calendar mechanism according to a preferred variant of the invention.

FIGS. 1A and 1B show the display mechanism for 24 hours and the day of the week of a calendar mechanism according to a preferred variant of the invention, in sectional view and plan view respectively. FIGS. 1A and 1B are encircled by the case 0 to indicate the position of the wheel train inside the watch. The case 0 contains buttons 10, 26 and 48 for the correction of the days of the week, day values and month values respectively. These correction mechanisms will be explained further below on the basis of the following FIGS. 2A, 2B, 3A, 3B, 3C and 4A, 4B. The hour motion work, on which an hour wheel 1 that preferably comprises 35 teeth is arranged, is evident in FIG. 1A. The hour wheel 1 meshes with a 24-hour wheel 2, which comprises twice the number of teeth, and therefore preferably 70 teeth. The 24-hour wheel 2, which performs a complete rotation each day, is mounted to be rotationally fixed with a transmission wheel 3, which meshes with a 24-hour display gear 4 that comprises an identical number of 46 teeth according to the preferred embodiment illustrated here. The 24-hour display gear 4 is mounted coaxially to a days of the week star 7 with 7 arms, which is driven at the rate of once a day by a pawl 6 coaxial to the 24-hour wheel 2 in a meshing level illustrated later in FIG. 2B. The coaxial mounting of the 24-hour display gear 4 in relation to the days of the week star 7 allows better legibility of these display parameters, e.g. through concentric rings.

Figures 2A, 2B:
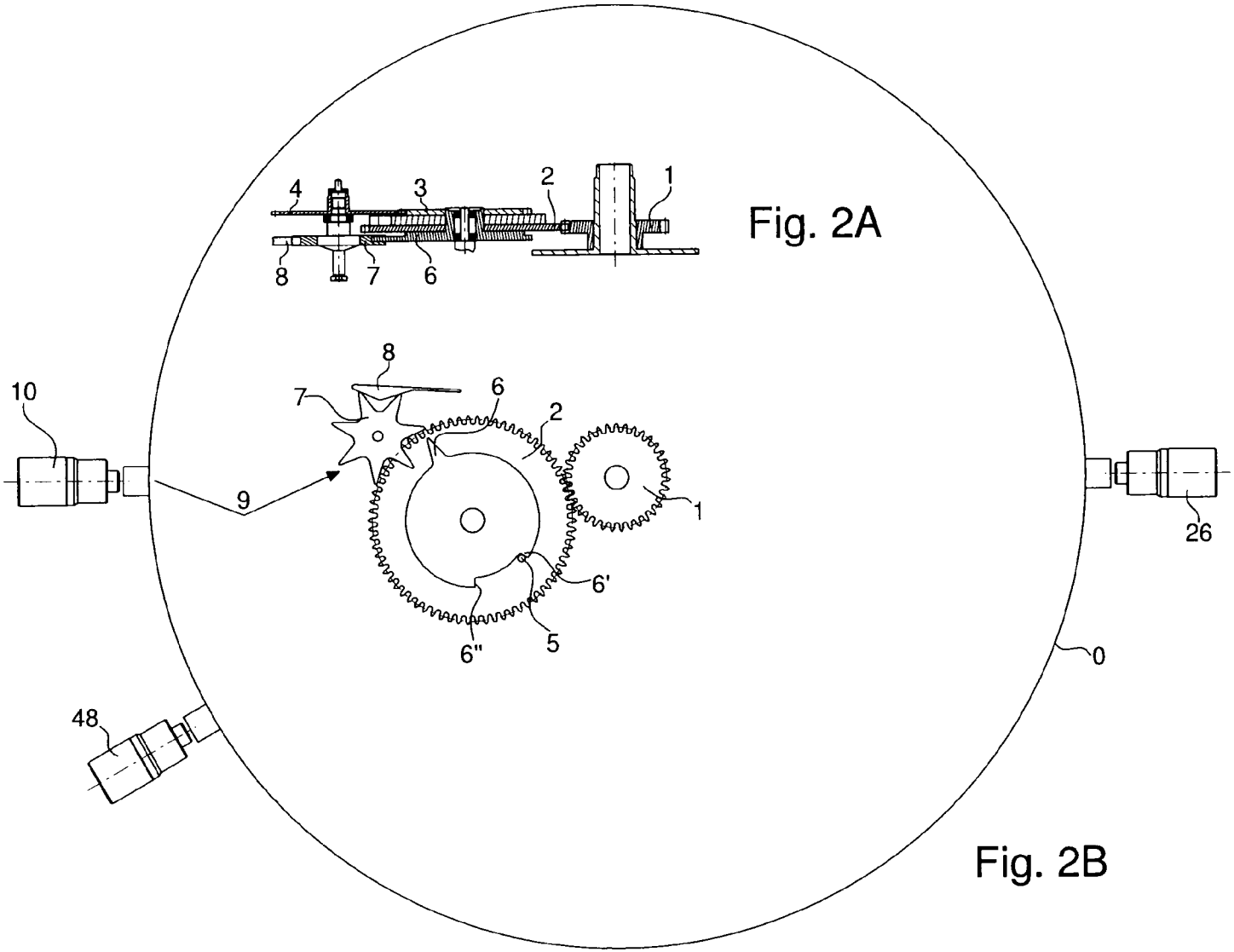
FIGS. 2A and 2B respectively show the sectional view of FIG. 1A and a plan view in another meshing level of the control and display mechanism for the day of the week.

FIG. 2A is identical to FIG. 1A except for the additional part given reference 8, which shows the elastic indexing element of the days of the week star 7. FIG. 2B shows a plan view of the index wheel train of the days of the week star 7 in a meshing level lower than that of the transmission wheel 3 at the 24-hour display wheel 4. The pin 5 that is integral with the 24-hour wheel The pin 5 that is integral with the 24-hour wheel causes the pawl 6 that meshes with the days of the week star 7 to rotate and causes it to perform a seventh of a turn each day. Meshing takes place on a sector located between about 10 and 11 o'clock on the 24-hour wheel 2 in FIG. 2B, which means that the daily indexing of the day of the week in this configuration takes place between about 2 and 4 o'clock in the morning. The indexing of the days of the week star 7 by a seventh of a turn precisely is guaranteed by the elastic indexing element 8, which positions itself between two teeth of the days of the week star 7 so that each indexing step corresponds to exactly a seventh of a turn.

The pawl 6 of the 24-hour wheel is preferably arranged as an element coaxial to the 24-hour wheel 2 but not fully rotationally fixed with this 24-hour wheel 2, so that the adjustment of the day of the week can be conducted independently of the calendar mechanism and the hour of the day. In fact, the arrangement of this pawl 6 on a meshing gear provides a degree of freedom in rotation between a first abutment 6', against which the pin 5 of the 24-hour wheel comes to rest when the 24-hour wheel 2 turns in anti-clockwise direction (i.e. when the hour wheel 1 turns in clockwise direction during normal functioning of the watch), and a second abutment 6", against which the pin 5 of the 24-hour wheel would come to rest if the 24-hour wheel turned in the reverse direction. The magnitude of this degree of freedom, which preferably corresponds to an angle sector of 20 to 30 degrees, is determined such that it is possible to cause the days of the week star 7 to turn, e.g. in clockwise direction for the embodiment illustrated in FIG. 2B, without disturbing the normal operation of the hour wheel 1 even if the pawl 6 of the 24-hour wheel is located in a meshed position with the teeth of the days of the week star 7, e.g. in the sector located between about 10 and 11 o'clock of the 24-hour wheel indicated above in FIG. 2B for the described preferred embodiment. In the case where the pawl 6 of the 24-hour wheel comes to be positioned between two consecutive teeth of the days of the week star 7 at the moment of adjustment, this will then simply be turned in anticlockwise direction without either posing any resistance to the days of the week star 7 until it arrives at the second abutment 6" or influencing the operation of the 24-hour wheel 2. Therefore, the normal operation of the hour wheel 1 is fully protected during the adjustment operation whatever the hour at which this is conducted. If this operation is conducted while the pawl 6 of the 24-hour wheel is located between two teeth of the days of the week star 7, the usual daily meshing would then no longer occur, since the pawl 6 of the 24-hour wheel will then be located outside the usual meshing sector located between 10 and 11 o'clock and the first abutment 6' will only be readjusted by the pin 5 later outside this sector.

The adjustment of the day of the week is conducted by means of a manual actuator 10 arranged on the case 0. According to the preferred embodiment described in FIGS. 2A and 2B, the manual actuator for adjustment of the days of the week 10 is a button, which is successively pressed, 6 times at maximum, to reach the desired day. The adjusting mechanism 9, which enables pulses to be transmitted from the button to the days of the week star 7, is not shown in FIG. 2B for reasons of clarity; however, such mechanisms are known to the person skilled in the art. According to the shown preferred embodiment, it is thus only possible to adjust the day of the week in a single direction. As an alternative, it would be possible to use a shaft as manual actuator 10 instead of a button, in which case the rotation of the shaft could drive the days of the week star 7 to rotate in both directions with an appropriate mechanism for adjusting the days of the week 9. However, this alternative has the disadvantage of not guaranteeing that the adjustment is possible in the opposite direction when the pawl 6 of the 24-hour wheel is engaged with the teeth of the days of the week star 7, since at this moment this would be brought against the first abutment 6' and would render any correction impossible without damaging the shaft and/or the movement. The preferred solution described on the basis of FIGS. 2A and 2B allows such a disadvantage to be avoided.

The fact that the adjustment of the day of the week never has an impact on the movement of the 24-hour wheel 2 assures not only the independence of this adjustment in relation to the display of the hours and the minutes, but also in relation to the values of the months and the day of the month determined by the calendar mechanism according to the invention. In fact, this latter is driven by the movement by an integral meshing segment of the 24-hour wheel 2—as explained further below in light of the following figures—which is never influenced by the adjustment of the day of the week. Thus, the correction of the day of the week is not correlated to the values of the day and the month displayed by the preferred embodiment of the calendar mechanism described according to the invention.

Figures 3A, 3B, 3C:
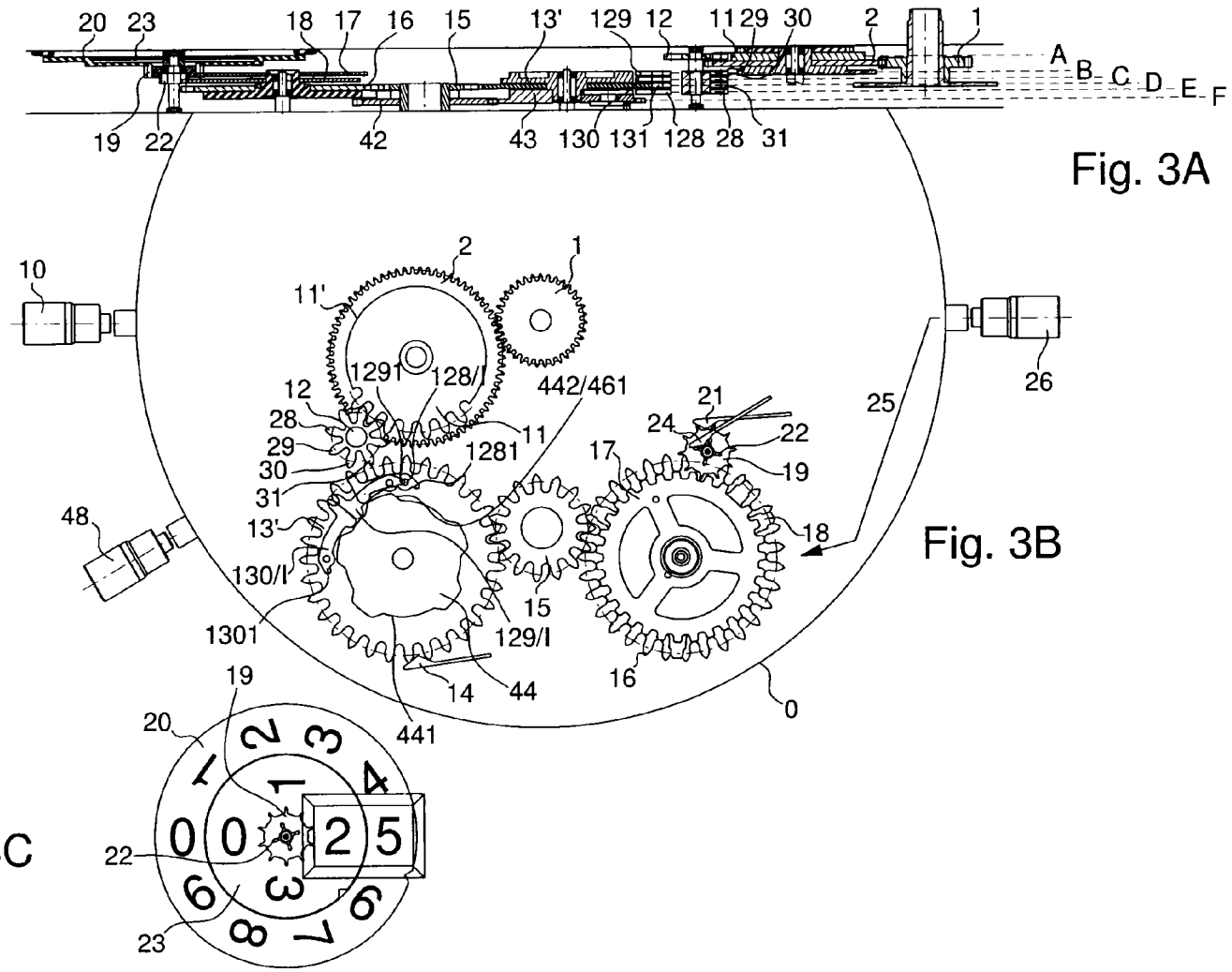
FIG. 3A shows a view in partial section of the calendar mechanism according to a preferred variant of the invention.
FIG. 3B shows a partial plan view of the calendar mechanism according to the preferred variant of the invention illustrated in FIG. 3A, in particular with the program wheel and the retractable teeth.
FIG. 3C shows a plan view of the display device of the calendar mechanism according to the preferred variant of the invention illustrated in FIGS. 3A and 3B.

FIGS. 3A and 3B respectively show a sectional view and a plan view of the drive wheel train for display of the day of the month from the movement onwards. FIG. 3B in particular shows the position of this wheel train in relation to the case 0 and the manual correction actuators 10, 26 and 48 respectively for the day of the week, as explained above with respect to FIGS. 2A and 2B, the day of the month and the month. FIG. 3B will serve to explain in particular the operation of the adjustment mechanism of the values of the day of the month.

In the following reference is made alternatively to FIGS. 3A and 3B, which could be consulted in combination for better comprehension of the drive wheel train of the calendar mechanism according to the illustrated preferred embodiment. The hour wheel of the movement 1 meshes with a 24-hour wheel 2 consisting of twice the number of teeth. Arranged on this 24-hour wheel 2 is a day meshing segment 11, which here consists of 7 teeth spaced 15 degrees such that the passage from one tooth to the other occurs every hour. This day meshing segment of the 24-hour wheel 11 meshes in a first level A, indicated in FIG. 3A and more clearly visible in FIG. 3B, with a calendar day index wheel 12, which consists of 8 teeth in this meshing level. Thus, each day the 24-hour wheel causes the calendar day index wheel 12 to perform a complete rotation when meshing with the 7 teeth of the meshing segment 11, i.e. in the space of 8 hours. When the calendar day index wheel 12 does not mesh with the toothed meshing segment 11, it is nevertheless resting against a non-toothed segment of the 24 h wheel, given the reference 11' in FIG. 3B, and thus is held in position. The meshing segment of the 24-hour wheel 11 and the calendar day index wheel 12 are thus preferably arranged so that this latter performs a complete rotation between 18.00 hours and 2.00 hours in the morning each day and the indexing with the day program wheel 13 takes place between 20.00 hours and midnight.

As can be seen in FIG. 3A, the calendar day index wheel 12 has a plurality of teeth 28, 29, 30, 31 distributed over different meshing levels B, C, D, E. These teeth are, moreover, consecutive and consequently potentially mesh every hour with the day program wheel 13. FIG. 3B shows meshing level D of tooth 31, the third from the top in FIG. 3A, made with the day indexing gear 13' of the day program wheel 13. The tooth 31 is preferably arranged to mesh with a corresponding tooth 131 of the day indexing gear 13' between 23.00 and midnight. In contrast to tooth 31 of the calendar day index wheel 12, this tooth is never the same each day and each time corresponds to another tooth of the tooth system of the day indexing gear 13', having a homogeneous external tooth system of 31 teeth (i.e. wherein the height of each tooth and the spacing between each of them is identical), since it is defined solely in relation to the tooth 31 of the calendar day index wheel 12. The day indexing gear 13' advances by pitch by one tooth because of the elastic indexing element of the program wheel 14, which comes between two consecutive teeth after each jump.

Other teeth 28, 29, 30 of the calendar day index wheel 12 serve to conduct an additional readjustment for months of less than 31 days in association with corresponding pivoting retractable teeth 128, 129, 130 arranged on the program wheel. The first indexing tooth 29 of the calendar day index wheel 12 thus meshes with a first pivoting retractable tooth 129, of which the rotation axis is integral with the day indexing gear 13' in a first meshing level B located just below meshing level A in FIG. 3A for indexing from the 29th to the 30th day in each month of February. Meshing only takes place when the pivoting tooth is in a so-called "active" position, i.e. is capable of being driven by the corresponding indexing tooth of the calendar day index wheel 12. These "active" positions 128A, 129A, 130A of each of the pivoting retractable teeth 128, 129, 130 are illustrated by the different sequences in FIG. 6 described below. In this case, each of the pivoting retractable teeth 128, 129, 130 is preferably superposed on the external tooth system of the day indexing gear 13' in their respective meshing levels B, C, E. In FIG. 3B these pivoting teeth 128, 129, 130 are shown in inactive positions, 128I, 129I, 130I respectively, in the month of March, which does not require any readjustment because it has 31 days.

Similarly, the second indexing tooth 30 of the calendar day index wheel 12 can mesh with a second pivoting retractable tooth 130, of which the rotation axis is also integral with the day indexing gear 13' when this is located in active position 130A, for indexing from the 30th to the 31st day for months of less than 31 days. According to the illustrated preferred embodiment, the meshing takes place in a second meshing level C located just below the previous meshing level B in FIG. 3A.

Finally, a third indexing tooth 28 of the calendar day index wheel 12 meshes with a third pivoting retractable tooth 128, of which the rotation axis is also integral with the day indexing gear 13' when this is located in active position 128A, for indexing from the 28th to the 29th day of the month of February in leap years. According to the illustrated preferred embodiment, this meshing takes place in a third meshing level E located just below meshing level D described previously.

As is clearly evident from FIG. 3A, the first, second, third and fourth meshing levels are arranged in order (B, C, D, E) from said meshing level A of said calendar day index wheel 12 with said day meshing segment 11. Such an arrangement is advantageous because cam surfaces of the month program wheel 43 are superposed in levels B and C, which readily facilitates the precise mounting of each of the parts.

It can be seen in FIG. 3B that neither the day index wheel 12 nor the day indexing gear 13' has long teeth, which facilitates their machining. Moreover, the projection of the indexing teeth 29, 30, 31, 28 in their respective meshing levels B, C, D, E is superposed on the tooth system of the day index wheel 12 in meshing level A with the meshing segment 11: they thus form a homogeneous and continuous toothed sector in a plane perpendicular to the rotation axis of the calendar day index wheel 12 with a depth that allows good meshing reliability, wherein the angular spacing between each tooth itself assures unit incrementation of the day program wheel 13.

FIG. 3B shows a month cam 44, the control surfaces of which determine the active or inactive position of the pivoting retractable tooth 130 in meshing level C. This month cam 44 thus defines a cam surface for months of less than 31 days 441, in which it will permit indexing from the 30th to the 31st day of the month to take place, preferably between 22.00 and 23.00 hours according to the illustrated preferred embodiment. This month cam 44 preferably also comprises a cam surface for the months of February 442, in which it will permit indexing from the 29th to the 30th day of the month to take place, preferably between 21.00 and 22.00 hours according to the illustrated preferred embodiment. The cam surface for the months of February itself controls the active or inactive position of the pivoting retractable tooth 129 in meshing level B. The cam surfaces 441, 442 of the month cam 44 are distributed over twelve sectors, which can be seen in FIG. 3B, but are only given detailed references in FIGS. 6A and 6B described below. Each of the sectors of the cam surfaces correspond to a month of the calendar year and the month cam 44 is arranged integrally with a month program gear 43 indexed by a twelfth of a turn at the end of each month, i.e. to change the value of the month. The control wheel train for this indexing operation is described further below on the basis of FIGS. 4A and 4B.

Figure 6A:
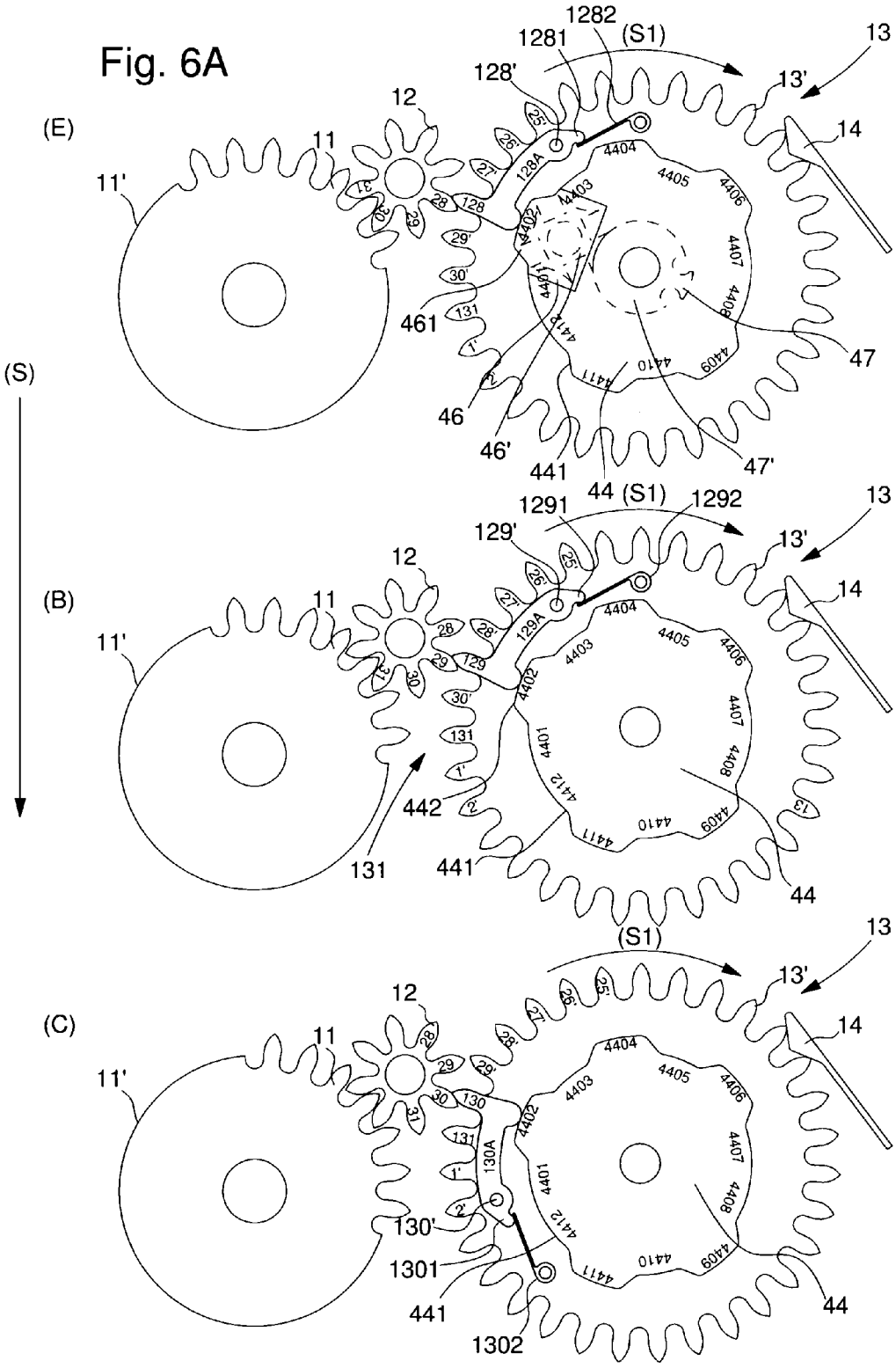
FIGS. 6A and 6B show the different indexing sequences respectively for the pivoting retractable teeth and the day indexing gear on their respective meshing levels for a perpetual calendar mechanism using a gear wheel according to a preferred embodiment illustrated in FIG. 5 on a 28th February of a non-leap year.
Figure 6B:
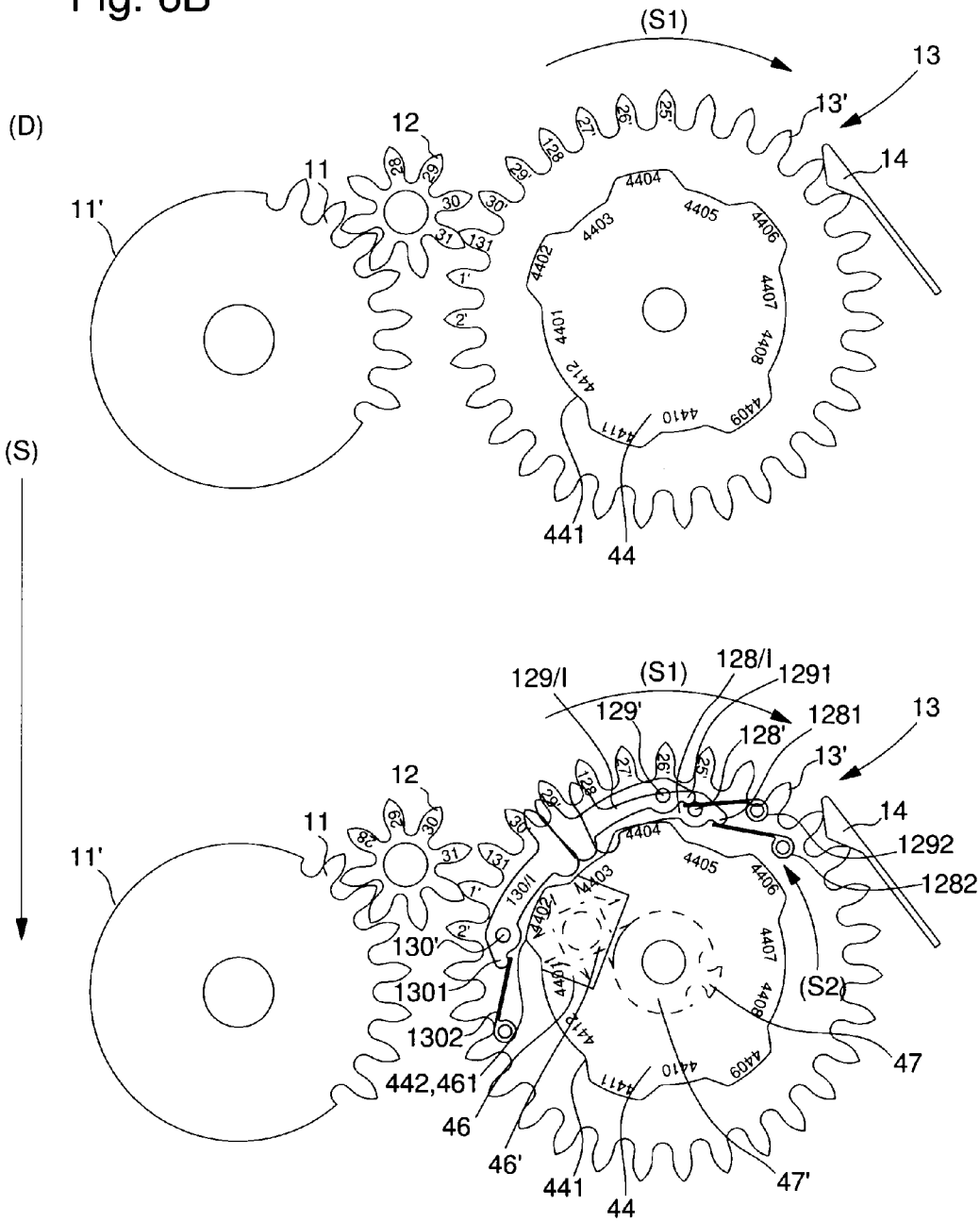

At the bottom of FIG. 3A a meshing level F can be seen that corresponds to that of an intermediate month control wheel 42 with the month program gear 43 and a fixed leap year indexing finger 47 is also present that is classically arranged on a fixed wheel 47' that can be seen, for example, in FIGS. 6A and 6B. This leap year indexing finger 47 that allows a Maltese cross 46', more clearly visible in FIG. 6, to perform a quarter turn each year, during which the month program gear 43, with which it is integrated, performs a complete rotation. The Maltese cross 46', which meshes with the leap year indexing finger 47 in an additional meshing level not given a reference in the figures, is integral with a leap year cam 46, the cam surface 461 of which (only visible in FIG. 6) is similar in meshing level E to the cam surface 442 for the month of February. This cam thus allows the day value to be advanced from 28 to 29 for non-leap years during the evening of 28th February, preferably between 20.00 and 21.00 hours according to the illustrated preferred embodiment.

At meshing level D it can be seen in FIGS. 3A and 3B that, via an intermediate day wheel 15 arranged coaxially but to be freely rotatable in relation to the intermediate month control wheel 42, the day indexing gear 13' meshes with a day wheel 16 also provided with 31 teeth like the day indexing gear 13'. The intermediate day wheel 15 only constitutes a return for all the indexing movements on the day program wheel 13 which are integrally responded to on the day wheel 16, and conversely all the rotation movements of the day wheel 16 are integrally responded to at the day indexing gear 13' that forms the skeleton of the day program wheel 13, and on which are also mounted the pivoting retractable teeth 128, 129, 130, each of which comprises a respective lug 1281, 1291, 1301, the function of which will be explained further below on the basis of FIGS. 6A and 6B. Thus, no elastic indexing element is required for indexing the day wheel 16. Where the height in the case 0 is sufficient, the program wheel 13 and day wheel 16 could be arranged coaxially, or even merged. According to the described preferred embodiment, the separation of program wheel 13 and day wheel 16 allows the unit formed by the day program wheel 13 dedicated to meshing with the movement for automatic correction of the days for months of less than 31 days to be functionally isolated from the unit formed by the day wheel 16, units wheel 17 and tens wheel 18, which are mutually coaxial and rotationally fixed and are dedicated to meshing with the display gears such as those illustrated in FIG. 1C, for example.

The units wheel 17 is divided into 31 equal angle sectors, on which 30 teeth and a sector without teeth are located. The units wheel 17 drives a gear for actuating a units display disc 19 every day of the month except one. The units display disc 20 that is integral with the gear for actuating the units display disc 19 is thus indexed by one unit every day except on passage from the 31st day of the month to the first of the following month where only the tens display disc 23 is incremented. The gear for actuating the units display disc 19 comprises 10 teeth and is indexed by pitch by a tenth of a turn because of the elastic indexing element of the units disc 24, which comes between two consecutive teeth.

Similarly, the tens display disc 23 is integral with an actuating gear, i.e. the gear for actuating the tens display disc 22, which has the shape of a cross with 4 arms and is indexed a quarter turn during passage from the 9th to the 10th day, from the 19th to the 20th day, from the 29th to the 30th day, and from the 31st to the 1st day. The jump of a quarter turn is assured by the elastic indexing element of the tens display disc 24, which comes between two adjacent arms of the cross; and the indexing on these day values is assured by long teeth arranged on the tens wheel 18, which is also divided into 31 sectors, but only comprises 4 long teeth, of which 3 are arranged at 9 sector intervals and the 4th following the 3rd for passage from the 31st day to the first of the following month.

The wheel train for display of the day of the month composed of elements with references 16 to 24 from the day wheel 16 to the display discs for units 20 and tens 23 is partially visible in each of FIGS. 3A, 3B and 3C: FIG. 3A shows the whole of the wheel train except for the elastic indexing elements 21 and 24 of each actuating gear 19 and 22 respectively associated with the display disc for units and for tens 20 and 23, FIG. 3B shows a meshing level located below these display discs for units 20 and for tens 23, which are consequently only visible in FIG. 3C.

The adjustment of the day of the month is conducted by means of the manual actuator 26 arranged on the case 0. According to the preferred embodiment described in FIGS. 3A and 3B, the manual actuator 26 for adjustment of the day is a button, which is successively pressed, 30 times at maximum, to reach the desired day. The adjusting mechanism 25, which enables pulses to be transmitted from the button to the day gear 16, is not shown in FIG. 3B for reasons of clarity; however, such mechanisms are known to the person skilled in the art. As an alternative, it would be possible to use a shaft as manual actuator 26 instead of a button, in which case the rotation of the shaft could drive the day wheel 16 to rotate in both directions with an appropriate mechanism for adjusting the days of the week 26. According to the shown preferred embodiment, as well as for the proposed alternative solution, it is not possible, however, to conduct such an adjustment of the day when the teeth 28, 29, 30 or 31 of the day index wheel 12 are engaged with the day program wheel 13, that is to say between 20.00 and 24.00 hours. In fact, the direct engagement of the day index wheel 12 with the day meshing segment of the 24-hour wheel 11 would then tend to pass these indexing operations on to the hour wheel 1, which is not possible without damaging the normal functioning of the movement.

Figures 4A, 4B:
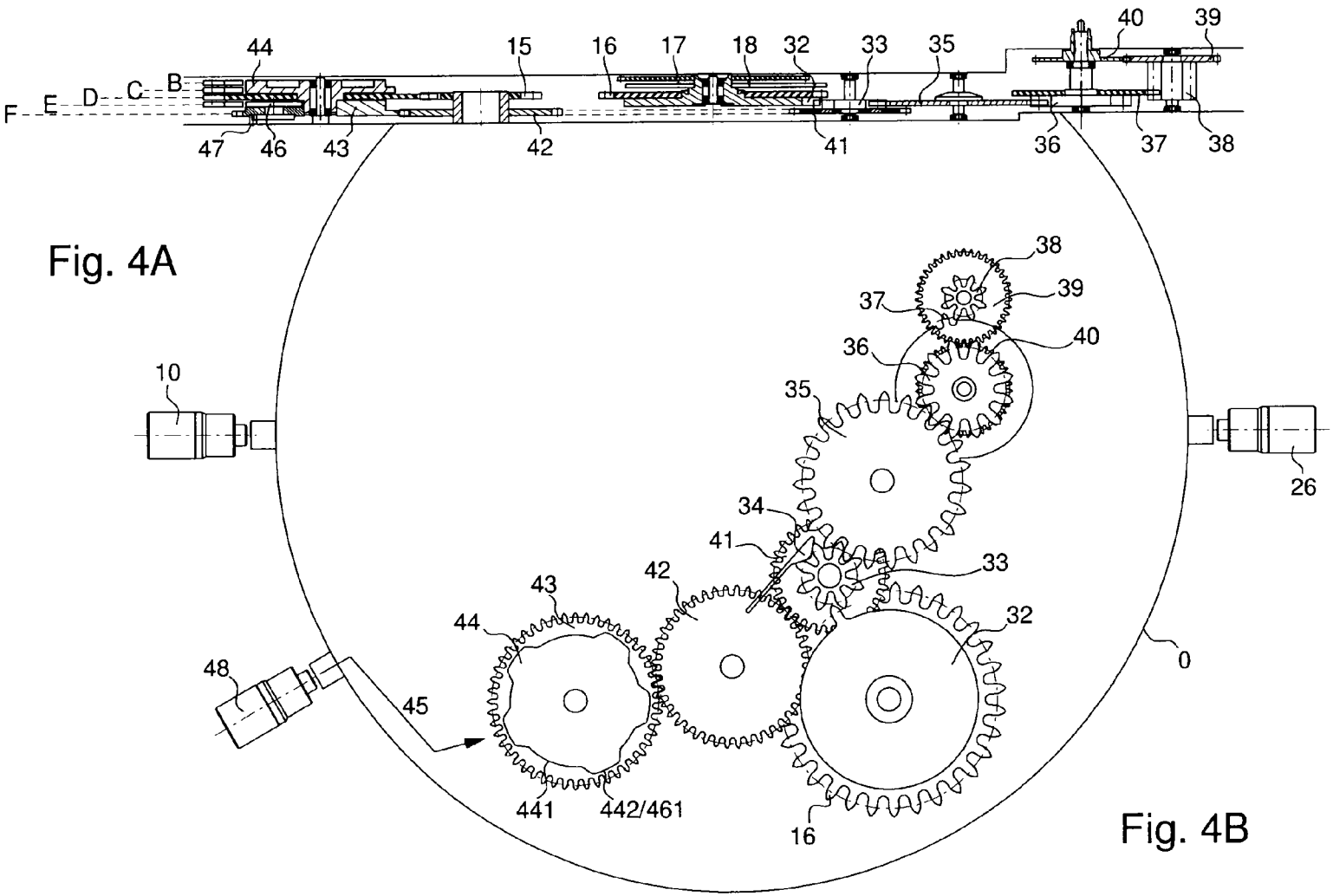
FIG. 4A shows another sectional view of the calendar mechanism according to a preferred variant of the invention, in particular showing the control mechanism for the program wheel, the display of the months and leap years.
FIG. 4B shows the partial plan view of the calendar mechanism according to a preferred variant of the invention illustrated in FIG. 4A.

FIGS. 4A and 4B show a sectional and a plan view respectively of the calendar mechanism according to a preferred variant of the invention, in which are described the control wheel trains for positioning the month program gear 43 in order to adequately position the pivoting retractable teeth, as well as the wheel trains for displaying months and leap years. As in the previous FIGS. 2A, 2B and 3A, B, C, the manual actuators 10, 26 and 48 are shown arranged on the case 0; it will be seen further below how the adjustment of the months is conducted by means of the manual actuator 48.

Evident in the central part of FIG. 4A is a gear, on which a monthly indexing tooth 32 visible in FIG. 4B is arranged. This monthly indexing tooth 32 meshes with a monthly indexing gear 33 with 8 teeth rotationally fixed with a month control wheel 41 with 32 teeth, which meshes in meshing level F with the intermediate month control wheel 42 that is coaxial but not rotationally fixed with the intermediate day wheel 15, and which in turn meshes with the month program gear 43 with 48 teeth that are rotationally fixed with the month cam 44 visible in FIG. 4B. The monthly indexing gear 33 performs exactly ⅛ of a turn each month because of the elastic indexing element 34, which comes between two of its consecutive teeth. The gear ratio between the number of the monthly indexing gear 33 and the month program gear 43 allows this to be indexed by exactly 1/12 of a turn each month.

The monthly indexing gear 33 additionally meshes with an intermediate monthly index wheel with 23 teeth, which in turn meshes with a gear for actuating the months display 36 with 12 teeth. The gear ratio of 8/12 between the monthly indexing gear 33 and the gear for actuating the months display 36 assures that this latter performs exactly a twelfth of a turn at the end of each month. The gear for actuating the months display 36 is rotationally fixed with an annual indexing tooth 37, which is positioned on a wheel that performs a complete rotation each year. This annual indexing tooth 37 meshes with a leap year actuating gear 38 provided with 8 teeth, which is shifted by 2 teeth, i.e. 90 degrees, during each meshing with the annual indexing tooth 37. The leap year actuating gear 38 is rotationally fixed with an intermediate leap year wheel 39 provided with 39 teeth that meshes with a leap year display wheel 40 also comprising 39 teeth mounted coaxially to the actuating gear for months display 36 such that the indicators of the months and leap years, typically hands pointing at concentric rings arranged on the dial of a watch, can be arranged to rotate around the same motion work in order to improve legibility for the user. The person skilled in the art will understand that the numbers of teeth indicated for the elements forming the wheel trains described in FIGS. 4A and 4B for months display (elements 33-36), the leap year display (elements 37-40) and the control of the position of the month program gear 43 (elements 33, 41, 42, 43) are given by way of example within the framework of the illustrated preferred variant with an adequate meshing efficiency to implement the invention, but must not be considered restrictive.

The month program gear 43 is integral with the month cam 44, which comprises a first surface cam for months of less than 31 days 441 visible in FIG. 4B and corresponding to meshing level C visible in FIG. 4A. This cam surface enables the value of the day of the month to be indexed from 30 to 31. The month cam 44 also comprises a cam surface 442 in meshing level B for correction of the months of February, i.e. to allow the day to pass from 29 to 30. In fact, the said leap year cam 46 mounted integrally with the month program gear 43 and visible in FIG. 4A allows the day to pass from 28 to 29 when the year is not a leap year by acting on the pivoting retractable tooth in meshing level E located just above meshing level F. The month program gear 43 consequently serves to determine the active position 128A, 129A, 130A or inactive position 128I, 129I, 130I of each of the retractable teeth 128, 129, 130 when a readjustment is necessary, i.e. in months with 30 days and the months of February. To do this, the cam surfaces on each meshing level B, C, E must be arranged so that each pivoting retractable tooth located in this level is in active position for the readjustment for which they are respectively provided, i.e. respectively 29 to 30 in level B, 30 to 31 in level C and 28 to 29 in level E, or otherwise is in inactive position. According to the described preferred embodiment, the cam surfaces are distributed over twelve sectors each corresponding to a month of the year. Thus, the month program gear 43 that is rotationally fixed with the month cam 44 acting on the pivoting retractable teeth 128, 129, 130 in the different meshing levels B, C, E must be synchronised over the month values displayed and indexed each time the day passes from 31 to 01 and vice versa. This is the reason why the control wheel train, which according to the illustrated preferred embodiment is formed by elements 15, 16, 32, 33, 41 and 42, enables retroaction from the day indexing gear 13' to the month program wheel. The day indexing gear 13' performs at least 1/31 of a turn each day (i.e. 1/31 for normal days, whereas for the last days of months of less than 31 days it performs the additional readjustment required of 1/31 of a turn once or more for months with 30 days and February) to index the month program gear 43 by a twelfth of a turn at the end of each month at the same time as the gear for actuating the months display 36 is also indexed by 1/12 of a turn.

According to the described preferred embodiment of the calendar mechanism, the control wheel train of the month program gear formed from the elements with references 15, 16, 32, 33, 41, 42 is formed from a first kinematic chain from the day indexing gear 13' to the day gear 16, which forms the first element of the day display wheel train (16-24), via the intermediate day wheel 15, while a second kinematic chain starts from the day gear 16 and the monthly indexing tooth 32 to return to the month program gear 43 arranged coaxially but to be rotationally independent of the day indexing gear 13', via the monthly indexing gear 33 and the month control wheel 41, which are rotationally fixed, and the intermediate month control wheel 42. The intermediate gears 15 and 42, i.e. the intermediate day wheel 15 and the intermediate month control wheel 42, are arranged as a single intermediate wheel comprising two coaxial and rotationally independent gears in order to save the maximum amount of space on the plate, e.g. for other clock modules. The intermediate month control wheel 42 meshes in level F with the month program gear 43, whereas the intermediate day wheel 15 meshes in level D with the day indexing gear 13'. According to the illustrated preferred embodiment, the intermediate wheels (intermediate day wheel 15 and intermediate month control wheel 42) turn in a contrary direction of rotation to one another since the intermediate day wheel 15 meshes directly with the day wheel 16 and consequently turns in a direction opposed to this, whereas the intermediate month control wheel 42 is driven by the monthly indexing finger 32 integral with the day wheel 16 via the gear formed by references 33, 41 and therefore turns in the same direction as the day wheel 16.

The adjustment of the months is conducted by means of the manual actuator 48 arranged on the case 0. According to the preferred embodiment described in FIGS. 4A and 4B, the manual actuator for adjusting the days of the week 48 is a button, which is successively pressed, 11 times at maximum, to reach the desired month. The adjustment mechanism 45, which allows the pulses of the button to be transmitted to the month program gear 43, is not shown in FIG. 4B for reasons of clarity. However, such mechanisms are known to the person skilled in the art. As an alternative, it would be possible to use a shaft as manual actuator 48 instead of a button, in which case the rotation of the shaft could drive the month program gear 43 to rotate in both directions with an appropriate mechanism for adjusting the months. According to the shown preferred embodiment, as well as for the proposed alternative solution, it is not possible, however, to conduct such an adjustment of the months when the monthly indexing tooth 32 meshes with the monthly indexing gear 33, i.e. during the night passing from the last day of the current month to the 1st of the following month. In fact, the engagement of the indexing tooth 32 would cause the day gear 16 to rotate, and this would result in an identical movement of the day program wheel 13, the engagement of which with teeth 28, 29, 30, 31 of the indexing gear 12 between 20.00 hours and 24.00 hours would cause the day meshing segment of the 24-hour wheel 11 to rotate. This would then tend to pass these indexing operations on to the hour wheel 1, which is not possible without damaging the normal functioning of the movement, as previously, if the adjustment of the days takes place between 20.00 hours and 24.00 hours.

Figure 5:
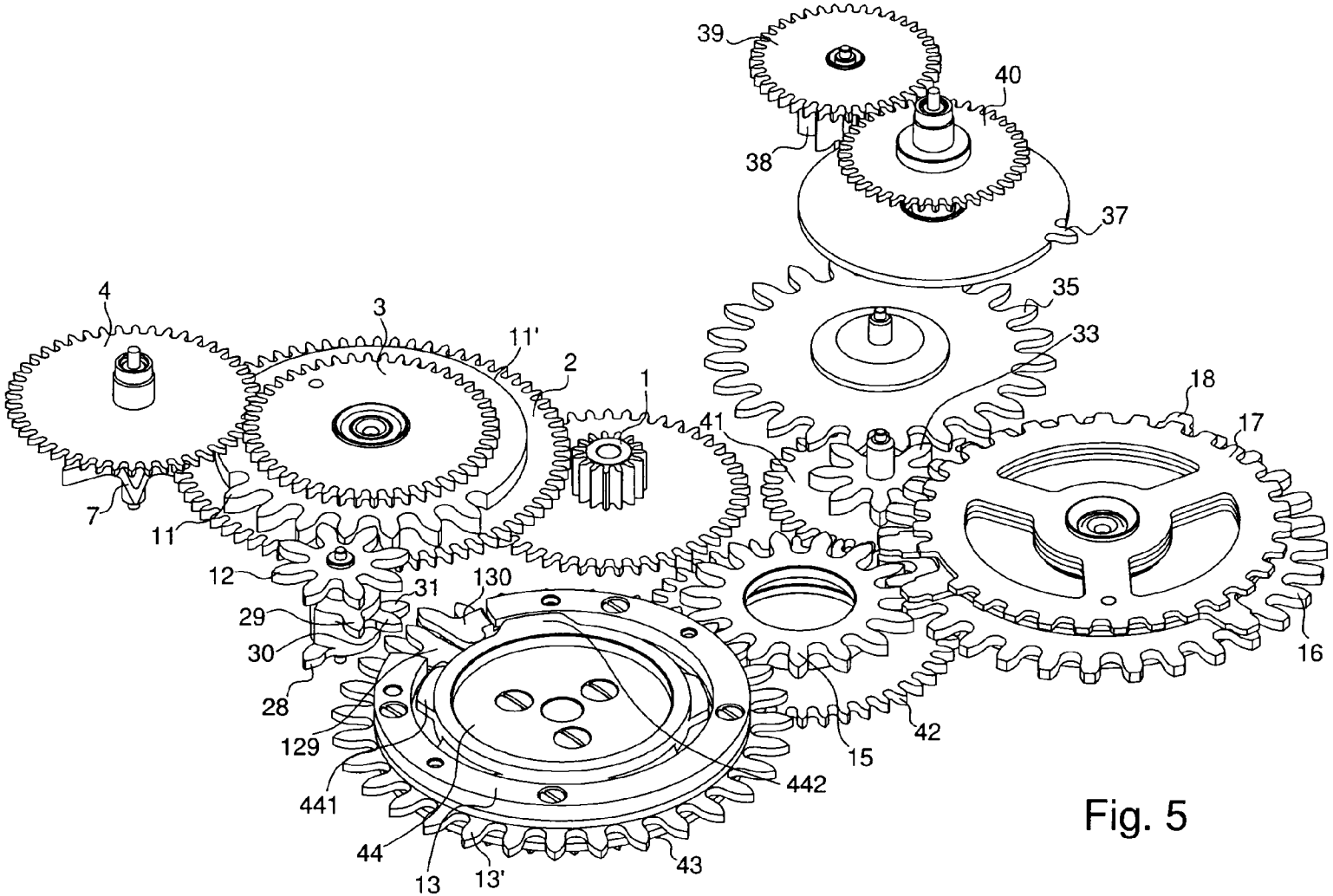
FIG. 5 shows a perspective view of the calendar mechanism according to the preferred variant of the invention using the preferred embodiments of different modules illustrated in the preceding figures.

FIG. 5 shows a perspective view of the calendar mechanism according to the preferred embodiment of the invention illustrated by the different previous figures. From the hour wheel 1 at the centre of the figure, it is possible to see the wheel train leading to the day program wheel 13 via the 24-hour wheel 2 and the day meshing segment 11 with 7 teeth, which meshes with the indexing gear 12. The different teeth 28, 29, 30, 31 of the day index wheel mesh in the respective meshing levels E, B, C, D illustrated in FIGS. 3 and 4 above with the pivoting retractable teeth 128, 129, 130 of the day program wheel 13 as well as tooth 131 of the day index wheel in level D. The pivoting retractable teeth 129 and 130 can also be seen in this figure, the tooth given the reference 128 is concealed. On the left of this figure the transmission wheel 3 of the 24-hour wheel 3, which is rotationally fixed with the 24-hour wheel 2, meshes with the 24-hour display gear 4 turning around the same motion work as the days of the week star 7 arranged in a lower level. The pawl 6 of the 24-hour wheel, which causes the days of the week star 7 to rotate, as well as the elastic indexing element 8 of the days of the week star are, however, also concealed in this figure.

During each meshing of the day program wheel 13 with one of the teeth of the day index wheel 12 of the calendar, the day indexing gear 13', on which the pivoting retractable teeth 128, 129 and 130 are mounted to pivot, performs 1/31 of a turn. The day gear 16 is caused to rotate around the same angle by means of the intermediate day wheel 15. Above the day wheel 16 can be seen the units wheel 17 and the tens wheel 18, the 4 long teeth thereof clearly visible arranged at the level of the 9th, 19th, 29th and 31st tooth of the tens wheel 18, the 31st tooth of the units wheel 17 being hollowed out. The day display mechanism is not shown for reasons of clarity. However, it could be noted that no elastic indexing element is useful on the periphery of the day wheel 16, since the movement of this wheel is still synchronised with that of the day indexing gear 13', itself indexed by the elastic indexing element 14 of the program wheel (concealed in FIG. 5).

The wheel train for display of the day of the month is not shown in its entirety in FIG. 5, since the respective display discs and the indexing elements (references 20-24 visible in FIG. 3C) and the monthly indexing tooth 32 that is coaxial and rotationally fixed with the day wheel 16 are concealed under this. However, the monthly indexing gear 33 is visible that enables the month control wheel 41, with which it is rotationally fixed, to drive the rotation of the month program gear 43, the tooth system of which is barely visible under that of the day indexing gear 13', by means of the intermediate month control wheel 42, and also to mesh with the wheel train for the months display. The month program gear 43 is rotationally fixed with a month cam 44, which comprises cam surfaces distributed over different meshing levels. 5 bulges of the first cam surface 441 for correction from the 30th to the 31st day are visible in particular in the meshing level C, and a bulge of the second cam surface 442 for correction from the 29th to the 30th day in the month of February is visible in meshing level B. To facilitate machining of the month cam 44 either in a single piece or in two concentric pieces mounted one on top of the other, it is evident that the preferred embodiment of the invention uses identical cam surfaces in meshing levels B and C for the month of February: in fact, the first cam surface 441 in the angle sector 4402 (visible in detail in FIGS. 6A and 6B) in meshing level C is completely concealed by the second cam surface 442 in meshing level B.

At the top of FIG. 5 the intermediate monthly index wheel 35 is visible that meshes with gear for actuating the months display 36 concealed under the monthly indexing tooth 37, with which it is coaxial and rotationally fixed. The monthly indexing tooth 37 performs a complete turn in one year and meshes with the gear for actuating the leap year display 38 that is coaxial and rotationally fixed with the intermediate leap year wheel 39, which meshes with the leap year display wheel 40 with an equal number of teeth. The leap year display wheel 40 is arranged coaxially to the gear for actuating the months display to allow better legibility for the user of the watch.

FIG. 6A shows the different indexing sequences for the pivoting retractable teeth 128, 129 and 130 with the respective teeth 28, 29, 30 of the day index wheel 12 on their respective meshing levels for a perpetual calendar mechanism according to the preferred embodiment illustrated in the figures on a 28th February of a non-leap year. For such a day, the calendar mechanism must readjust by 3 day values, which it does by means of each of the 3 pivoting retractable teeth 128, 129, 130 in their respective meshing level E, B and C with indexing teeth 28, 29 and 30 of the day index wheel 12.

The top figure shows the day indexing segment 11 as well as the position of the different teeth 28, 29, 30, 31 on a 28th February at 20.00 hours. At this time the tooth 28 of the day index wheel 12 meshes with the pivoting retractable tooth 128 mounted to pivot around a rotation axis 128' integral with the day indexing gear 13'. According to the illustrated preferred embodiment, the rotation axis 128' of the pivoting retractable tooth 128 is located slightly set back from the 25th tooth of the day indexing gear 13' given the reference 25'. The pivoting retractable tooth 128 is brought into active position 128A during passage from the 27th to the 28th day of this month by the leap year cam 46 integral with the Maltese cross 46' indexed once a year by means of the fixed leap year indexing finger 47 that is itself integral with a fixed wheel 47. According to the illustrated preferred embodiment, the fixed wheel 47 is coaxial to the month program gear 43 and the day program wheel 13'.

The tooth 28 of the day index wheel 12 and the pivoting retractable tooth 128 mesh in meshing level E so that the day program wheel 13 is driven 1/31 of a turn in the direction of rotation S1 identical to that of the 24-hour wheel 2 and contrary to that of the hour wheel 1, the clockwise direction of the hands of a watch here, for example, according to this view of FIG. 6A. It could be noted that the viewing direction of FIG. 6A—and also of the following FIG. 6B—is opposed to that of FIG. 3B, for example, in which the hour wheel 1 turns in the direction of hands of a watch and drives the 24-hour wheel 2 and the meshing segment 11 in the opposite direction to the hands of a watch.

The elastic indexing element of the day program wheel 14 allows the day indexing gear 13' to be indexed, which then meshes onto the day display wheel train (see references 15 to 24 illustrated in the other figures) by pitch by precisely 1/31 of a turn in direction S1, while a first elastic repositioning element 1282, which cooperates with a first lug 1281 affixed to the pivoting retractable tooth 128, allows this tooth to be replaced after indexing and to be held in lowered resting position.

The month cam 44 is divided into twelve equal angle sectors each corresponding to a month and given the respective references from 4401 for the month of January to 4412 for the month of December. As can be clearly seen in this first section of FIG. 6A, the leap year cam surface 461 of the leap year cam 46 is identical in meshing level E to the cam surface for months of less than 31 days 441 in level C visible in the following bottom figure, and the cam surface for months of February 442 visible in the following middle figure. Thus, according to a plan view of the month cam 44 starting from level B, all the above-mentioned cam surfaces 441, 442 and 461 are superposed for the month of February corresponding to the angle sector given the reference 4402. This arrangement facilitates both the machining and the assembly of the parts forming the month program wheel 43, since it is sufficient to verify the alignment of these different cam surfaces to assure proper functioning of the operation of each of the pivoting retractable teeth 128, 129 and 130.

Following down arrow S that indicates the direction in which the indexing sequences proceed for the end of the month of February from the top of FIG. 6A, we come to a second illustration showing a sectional view of the program wheels for the days 13 and the months 43 on another meshing level, B, in which the tooth 29 of the day index wheel 12 meshes with the pivoting retractable tooth 129 of the day program wheel 13 that is mounted to pivot around its rotation axis 129' integral with the day indexing gear 13'. According to the illustrated preferred embodiment, the rotation axis 129' is located slightly set back from the 26th tooth of the day indexing gear 13' given the reference 26'. This sequence takes place at 21.00 hours when the 24-hour wheel 2 has brought forward the day meshing segment of the 24-hour wheel 11 by one tooth and caused the day index wheel 12 to rotate one eighth of a turn to mesh onto the tooth 29 following tooth 28. While the pivoting retractable tooth 128 is brought back into inactive position 128I, the pivoting retractable tooth 129 is brought into active position 129A during passage from the 28th to the 29th day of this month, that is to say the indexing conducted the previous hour, because of the cam surface for the months of February 442 of the month cam 44. However, in the case of a February in a leap year, the active position 129A of the pivoting retractable tooth 129 would have been effective upon passing from the 28th to the 29th day of the month at midnight be regular meshing in level D (see FIG. 6B below). Similarly to the previous illustration at the top of FIG. 6A in the meshing level E, it is evident that the cam surface 442 of the month cam 44 for the month of February, i.e. for the indexing readjustment from the 29th to the 30th day in this month, is identical to the cam surface 441 of the month cam for the same month of February. The elastic indexing element of the day program wheel 14 enables the day indexing gear 13' to be indexed to rotate once again precisely 1/31 of a turn in direction S1.

As in the case of the first pivoting retractable tooth 128, the second elastic repositioning element 1292, which cooperates with a second lug 1291 affixed to the pivoting retractable tooth 129, allows this tooth to be replaced after indexing and to be held in lowered resting position.

Following arrow S down further indicating the direction in which the indexing sequences proceed for the end of the month of February, we reach a third illustration at the bottom of FIG. 6A that shows a sectional view of the program wheels for the days 13 and the months 43 along a third meshing level, C, located just below level B according to the preferred variant illustrated in particular in FIGS. 3 and 4, and in which the tooth 30 of the day index wheel 12 meshes with the pivoting retractable tooth 130 of the day program wheel 13 that is mounted to pivot around the rotation axis 130' of the pivoting retractable tooth 130 integral with the day program gear 13'. According to the illustrated preferred embodiment, the rotation axis 130' is located slightly set back from the 2nd tooth of the day indexing gear 13' given the reference 2'. This sequence takes place at 22.00 hours when the 24-hour wheel 2 has once again brought forward the day meshing segment of the 24-hour wheel 11 by one tooth and caused the day index wheel 12 to rotate one eighth of a turn to mesh onto tooth 30 following tooth 29 on the day index wheel 12. There again, while the pivoting retractable tooth 129 is brought back into inactive position 129I upon passage from the 29th to the 30th day of this month, that is to say the indexing conducted the previous hour, the pivoting retractable tooth 130 has been brought into active position 130A as a result of the cam surface for months of less than 31 days 441 of the month cam 44. However, for an ordinary month of 30 days, the active position 130A of the pivoting retractable tooth 130 would have been effective upon passage from the 29th to the 30th day of the month at midnight after regular daily meshing in level D (see FIG. 6B below). Similarly to the previous illustrations of FIG. 6A in the meshing levels B and E, it can be seen that the cam surfaces 441 and 442 of the month cam 44 are identical for the same month of February, i.e. in the angle sector given the reference 4402. In this meshing level C, however, 4 other identical bulges could be seen in the respective angle sectors 4404 corresponding to the month of April, 4406 corresponding to the month of June, 4409 corresponding to the month of September and 4411 corresponding to the month of November to conduct the readjustment from the 30th to the 31st day from 22.00 hours to 23.00 hours for the last days of this month. It can also be noted that as for the pivoting retractable teeth 128 and 129, a third elastic repositioning element 1302, which cooperates with a third lug 1301 affixed to the pivoting retractable tooth 130, allows this tooth to be replaced after indexing and to be held in a lowered resting position.

The elastic indexing element of the day program wheel 14 enables the day indexing gear 13' to be indexed to rotate once again by pitch by precisely 1/31 of a turn in the direction of rotation S1 for this last indexing readjustment.

As can be seen in particular from the different illustrations of FIG. 6A, all the pivoting retractable teeth 128, 129, 130 preferably have the same geometric shape, which substantially simplifies the manufacture of the day program wheel 13, on the one hand, and also the fabrication of replacement parts for the retractable teeth, which do not require any machining of dedicated elements for adjustment of the day of the month. The simple and homogeneous geometric shape for each of the pivoting retractable teeth 128, 129, 130 in combination allows the use of cam surfaces that are also homogeneous, as already discussed above, in each level for indexing readjustment (B, C, E) such that these teeth are superposed on the external tooth system of the day indexing gear 13' in position active 128A, 129A, 130A. Hence, the complexity of the whole of the proposed calendar mechanism is greatly reduced in relation to usual mechanisms.

In FIGS. 6A and 6B of the 31 teeth of the day indexing gear 13' only the first and second teeth of the day indexing gear 13' as well as the 25th to the 30th teeth, respectively given the references 1', 2', 25', 26', 27', 28', 29', 30', have been indicated as well as the tooth 131, which cooperates with the tooth 31 of the day index wheel 12, that is for indexing from the 31st day to the first of the following month in the described example when passing from 28th February to 1st March in a non-leap year. When the pivoting retractable teeth 128, 129 and 130 are in active position respectively 128A in the first illustration at the top of FIG. 6A, 129A in the second illustration in the middle of FIG. 6A, and 130A in the third illustration at the bottom of FIG. 6A, they respectively conceal teeth 28', then 29' and 30' of the day indexing gear according to the described preferred embodiment. However, these are visible in the illustration at the bottom of FIG. 6B described below.

FIG. 6B shows the last month indexing sequence, which follows the three indexing readjustments of the previous FIG. 6A for 28th February of a non-leap year, but which also takes place all the other days of the year from 23.00 hours to midnight. The same arrow S as in the previous FIG. 6A for the last indexing of the month is evident pointing downwards to indicate the direction in which the indexing sequences proceed. The lugs 1281, 1291 and 1301 as well as the elastic elements 1282, 1292 and 1302 are also shown in this figure, in contrast to the previous FIG. 5, where they have not been illustrated for reasons of clarity, and FIG. 3B where only the lugs are shown.

The first illustration at the top of FIG. 6B is a sectional view of day 13 and month 43 program wheels in a fourth meshing level D located just above level C in the preferred embodiment illustrated in particular in FIGS. 3 and 4, and in which the tooth 31 of the day index wheel 12 meshes with a tooth 131 of the day indexing gear 13'. This sequence takes place at 23.00 hours when the 24-hour wheel 2 has once again brought forward the day meshing segment of the 24-hour wheel 11 by one tooth in relation to the illustration at the bottom of the previous FIG. 6A, and has caused the day index wheel 12 to rotate one eighth of a turn to mesh onto the tooth 31 following tooth 30 on the day index wheel 12.

The illustration at the bottom of FIG. 6B shows a plan view of the program wheel 13 and the month cam 44 with the view of the elements located between the first meshing level A between the day meshing segment 11 and the day index wheel 12 up to the fixed wheel 47' and the leap year indexing finger 47 below meshing level E. Also evident now is the inactive position 128I, 129I, 130I of the different retractable teeth 128, 129 and 130 pivoting around their respective axis 128', 129', 130' in their respective meshing level E, B and C, once the day of the month has been indexed to 1st March at midnight, when the day index wheel 12 has performed an additional eighth of a turn, so that the tooth 31 no longer meshes with the day indexing gear 13'. The elastic elements 1282, 1292 and 1302 that cooperate respectively with lugs 1281, 1291, 1301 of the pivoting retractable teeth 128, 129 and 130 hold these in inactive position. Even if the day index wheel 12 contains 8 teeth in meshing level A with the day meshing segment 11, it only contains 4 thereof in the respective meshing levels B, C, D, E with the day program wheel 13, and more precisely one only in each respective level B, C, D, E such that the driving of the day index wheel 12 by the last tooth of meshing segment 11 over the following hour will not have any influence on the movement of the day program wheel 13. The day indexing gear 13' will therefore no longer be driven to rotate past this moment. However, the control wheel train (references 15, 16, 32, 33, 41, 42) described above, in particular on the basis of FIG. 4B, will still index the month gear 43 that is integral with the month cam 44 by a twelfth of a turn in direction S2, contrary to direction S1, during each passage from the 31st day to the 1st day of the following month. To prevent the too much energy being used for the movement during each change of the month, in an alternative embodiment it would be possible to separate the types of monthly indexing teeth associated with the months display and with retroaction on the month program gear 43. According to the proposed embodiment, these monthly indexing teeth are merged because the monthly indexing tooth with the reference 32 at the same time causes the indexing of the gear for actuating the months display 36 and the month program gear. In an alternative embodiment, it is conceivable that a second indexing tooth meshes in level F with a month control wheel 41 which is not rotationally fixed with the monthly indexing gear 33 in such a way that this tooth can be moved forward angularly by a few day values, e.g. between the 10th day and the 20th day of the month, and thus the indexing of the month program wheel does not take place simultaneously with that of the display of the current month so that a very substantial torque is not necessary for simultaneous indexing operations at the end of the month while assuring adequate positioning of the day program wheel 43 when the retractable teeth must be placed in active position, i.e. for a sufficiently long time before the last days of the month. Moreover, the day index wheel 12, which will have performed a complete turn after meshing with the 7 teeth of the toothed meshing segment 11, will be held in position until the next meshing of this same toothed sector by the surface of the sector without teeth 11', visible in all the illustrations of FIGS. 6A and 6B, which blocks it in rotation.

The reliability of the meshing proposed by the calendar mechanism according to the invention is improved compared to mechanisms using complex cam surfaces and/or movements with several components in translation for retractable teeth due to the fact that the position of the pivoting retractable teeth 128, 129 and 130 is only determined by the single degree of freedom in rotation each one has in relation to its respective rotation axis 128', 129' and 130'. Therefore, the cam surfaces for the different indexing readjustments to be conducted do not need to be sophisticated at all to display the pivoting retractable teeth 128, 129, 130 in their active positions 128A, 129A, 130A, as the height distance between the different angle sectors 4401-4412 of the month cam 44 simply determines their angular course during their change of state, i.e. from the inactive position to the active position and vice versa. This height is chosen so that each of the pivoting retractable teeth is superposed in their respective meshing level on the tooth system of the day indexing gear 13' when they are in active position 128A, 129A, 130A. Although in FIG. 6B the rotation axes of the pivoting retractable teeth 128', 129', 130' are not all located on the same circle, i.e. at equal distance from the centre of rotation of the day indexing gear 13', this arrangement could be advantageous if the cam surfaces for the months of less than 31 days 441, the month of February 442 and leap years 461 are identical in the different meshing levels E, B, C for the month of February in order to achieve the superposed arrangement of the pivoting retractable teeth 128, 129, 130 in relation to the 28th, 29th and 30th tooth, given the respective references 28', 29' and 30', of the day index wheel.

As can be seen in the view in FIGS. 6A and 6B, the readjustment for the missing days at the end of months of less than 31 days is conducted sequentially by the calendar mechanism according to the invention every hour over a period of 4 hours at maximum, i.e. from 20.00 to 24.00 hours, firstly in each of the 3 readjustment meshing levels E, B, C and then in the normal day indexing level D, while the day index wheel 12 is driven by the meshing sector of the 24-hour wheel 11. All the pivoting retractable teeth are driven by the same clock movement wheel train, and more precisely the same part (i.e. the day index wheel 12), such that there is no need for a dedicated wheel train for each correction, which simplifies the construction of the proposed calendar mechanism compared to classic mechanisms. The number of teeth of the day index wheel 12, fixed at 8 according to the selected preferred embodiment, has been chosen to perform a rotation around a sufficient angle to index the day program wheel 13, comprising the day index wheel 13' and pivoting retractable teeth 128, 129, 130, on which they are mounted, by 1/31 of a turn, at the same time with an adequate meshing depth. Moreover, the fact that the day index wheel 12 makes precisely one complete turn each day enables a similar movement to be repeated by day cycles starting from the same position. The fact that the meshing levels B, C, E are separated for all readjustment operations at the end of the month and the meshing level of the day indexing operations D allows a modular replacement, preferably meshing level by meshing level, for each of the parts of the day program wheel 13 and the day index wheel 12. This possibility provided by the calendar mechanism according to the invention is highly advantageous since meshing level D will be used every day, for example, while level B will be used once every year, level C 5 times a year and level E once a year three years out of four in non-leap years.

The calendar mechanism allows the day display to always be synchronised in relation to the movement, and, moreover, in both directions, such that an adjustment of the hour, classically by causing a crown arranged on the case 0 to rotate, will be transmitted to the hour wheel 1 and consequently to the calendar mechanism. This can be advantageous during a journey to a destination where the time zone is behind the region of origin, e.g. the west coast of the United States at 9 hours behind Europe. The user of a watch fitted with a calendar mechanism according to the invention will simply need to adjust the hour of his/her watch to −9 hours so that the day will automatically be adjusted backwards, e.g. from 1st March to 28th or 29th February, without requiring any dedicated handling for adjustment of the days of the month. Usage of the watch is only made easier in relation to watches provided with a usual day mechanism, for which no synchronisation with the movement is provided during adjustment in the reverse direction of operation.

What is claimed is:

1. A calendar mechanism comprising a day program wheel that is driven by a clock movement and actuates a wheel train for display of the days of the month, wherein said day program wheel comprises a day indexing gear that is advanced by one step each day by said clock movement, and a plurality of retractable teeth capable of being driven by said clock movement, wherein said retractable teeth are respectively mounted to pivot between an active position, in which they are driven by said clock movement, and an inactive position, in which they are not driven by said clock movement, wherein said active positions and inactive positions of said retractable teeth are determined by cam surfaces.

2. The calendar mechanism according to claim 1, wherein said day indexing gear has a homogeneous external tooth system of 31 teeth and is indexed by one step by a drive wheel train actuated by said clock movement, wherein said retractable teeth are integral with said day indexing gear and are driven into active position by the same drive wheel train actuated by said clock movement.

3. The calendar mechanism according to claim 2, wherein said active or inactive position of said retractable tooth is controlled by the position of a month program gear that is indexed each month by a twelfth of a turn by a control wheel train driven by said day indexing gear.

4. The calendar mechanism according to claim 3, wherein said control wheel train comprises an intermediate wheel comprising two independently rotatable coaxial gears, wherein the first gear is an intermediate day wheel driven by the day indexing gear and meshing with a day wheel actuating said wheel train for days display, and the second gear is an intermediate month control wheel driven by the day wheel and meshing with the month program gear.

5. The calendar mechanism according to claim 4, wherein the month program gear comprises separate cam surfaces distributed over at least a first meshing level and a second meshing level of said day program wheel, wherein said cam surfaces are distributed in twelve sectors, each corresponding to a month of the year and determining the position of at least two retractable teeth.

6. The calendar mechanism according to claim 5, wherein said cam surfaces in said first and said second meshing level are identical for the month of February.

7. The calendar mechanism according to claim 1, additionally comprising a display mechanism for the day of the week driven by the clock movement, wherein said display mechanism for the day of the week can be adjusted independently of said calendar mechanism at any hour of the day.

8. The calendar mechanism according to claim 1, wherein said calendar mechanism is a perpetual calendar mechanism and is wherein said day program wheel comprises a first pivoting retractable tooth that meshes in a first meshing level for indexing from the 29th to the 30th day in the month of February, a second pivoting retractable tooth that meshes in a second meshing level for indexing from the 30th to the 31st day for months of less than 31 days, and a third pivoting retractable tooth that meshes in a third meshing level for indexing from the 28th to the 29th day in the month of February in leap years, wherein the day indexing gear meshes in a fourth meshing level.

9. The perpetual calendar mechanism according to claim 8, wherein it comprises a leap year cam that is integral with a Maltese cross mounted to pivot on said month program gear, wherein said leap year cam acts in said third meshing level of said day program wheel, the profile of the cam surface of said leap year cam in said third meshing level is identical to said cam surfaces in said first and said second meshing level for the month of February.

10. The perpetual calendar mechanism according to claim 9, wherein the month program wheel is coaxial to the day program wheel and meshes in a fifth meshing level every month with an intermediate month control wheel that forms part of a control wheel train driven by said day indexing gear.

11. The perpetual calendar mechanism according to claim 10, wherein the clock movement comprises a 24-hour wheel fitted with a day meshing segment provided with a plurality of teeth that mesh with a day index wheel of the calendar in a sixth meshing level, wherein said day index wheel performs a complete rotation at most over 24 hours, said calendar index wheel of the calendar additionally comprising a first meshing segment, said day index wheel of the calendar additionally comprises indexing teeth, of which at least one is respectively disposed in the first meshing level, the second meshing level, the third meshing level and the fourth meshing level.

12. The perpetual calendar mechanism according to claim 11, wherein a first indexing tooth of the calendar day index wheel meshes with a first pivoting retractable tooth in active position in a first meshing level for indexing from the 29th to the 30th day in the month of February, that a second indexing tooth of the calendar day index wheel meshes with a second pivoting retractable tooth in active position in a second meshing level for indexing from the 30th to the 31st day for months of less than 31 days, and that a third indexing tooth of the calendar day index wheel meshes with a third pivoting retractable tooth in active position in a third meshing level for indexing from the 28th to the 29th day in the month of February in leap years, and that a fourth indexing tooth meshes with a tooth of the day indexing gear in a fourth meshing level, wherein said first, second, third and fourth meshing levels are arranged in order starting from said sixth meshing level of said day index wheel of the calendar with said day meshing segment.

13. The perpetual calendar mechanism according to claim 12, wherein projection of said indexing teeth in a plane perpendicular to the rotation axis of said calendar day index wheel forms a continuous and homogeneous toothed sector.

14. The perpetual calendar mechanism according to claim 8, wherein it additionally comprises a months display mechanism driven by a day wheel for display of the days of the month, and a leap year display mechanism driven by said months display mechanism and comprising a leap year indicator gear that is coaxial to a month indicator gear.

15. The perpetual calendar mechanism according to claim 11, wherein said indexing teeth of said day index wheel are arranged to mesh sequentially at hourly intervals with the day program wheel in said first, second, third and fourth meshing level while the day meshing sector of the 24-hour wheel meshes with said day index wheel.

* * * * *